US009995479B2

(12) United States Patent
Aho et al.

(10) Patent No.: US 9,995,479 B2
(45) Date of Patent: Jun. 12, 2018

(54) CAVITATION ENGINE

(71) Applicant: Richard E. Aho, Lauderdale Lakes, FL (US)

(72) Inventors: Richard E. Aho, Lauderdale Lakes, FL (US); William Walter Mee, West Palm Beach, FL (US)

(73) Assignee: Richard E. Aho, Lauderdale Lakes, FL (US)

( * ) Notice: Subject to any disclaimer, the term of this patent is extended or adjusted under 35 U.S.C. 154(b) by 240 days.

(21) Appl. No.: 15/155,338

(22) Filed: May 16, 2016

(65) Prior Publication Data

US 2016/0341420 A1 Nov. 24, 2016

Related U.S. Application Data

(60) Provisional application No. 62/162,970, filed on May 18, 2015.

(51) Int. Cl.

| | |
|---|---|
| ***F22B 3/06*** | (2006.01) |
| ***F24J 3/00*** | (2006.01) |
| ***F22B 3/04*** | (2006.01) |

(52) U.S. Cl.

CPC ..... *F22B 3/06* (2013.01); *F22B 3/04* (2013.01); *F24J 3/003* (2013.01)

(58) Field of Classification Search

CPC ..... F24J 3/003; F22B 3/04; F22B 3/06; F22B 27/16; F22B 27/00; F22G 1/10

(Continued)

(56) References Cited

U.S. PATENT DOCUMENTS 2,505,170 A * 4/1950 Burnstein ..... F22B 1/287 122/39
5,870,975 A * 2/1999 Luc ..... A61H 33/063 122/39

(Continued)

FOREIGN PATENT DOCUMENTS

WO 2012164322 A1 12/2012

OTHER PUBLICATIONS

International Searchiing Authority; Patent Cooperation Treaty PCT International Search Report; PCT/US2016/032689 dated May 16, 2015.

*Primary Examiner* — Steven B McAllister
*Assistant Examiner* — Steven Anderson, II
(74) *Attorney, Agent, or Firm* — Luedeka Neely Group, PC

(57) ABSTRACT

A cavitation engine configured to produce superheat steam from injected liquid water. The cavitation engine includes a funnel shaped impact chamber having an impact surface having a temperature of at least 375 degrees Fahrenheit, a small diameter opening at a bottom of the impact chamber, and an expansion chamber below the small diameter opening. The engine includes a fluid injector having an outlet positioned adjacent a largest diameter of the impact chamber and located to inject hyperbaric liquid water onto the impact surface of the impact chamber at supersonic velocities such that cavitation bubbles are present in the injected water. The outlet of the fluid injector and the impact surface are located relative to one another such that the outlet is spaced a distance from the impact surface of between 0.150 and 0.450 inches and the injected water hits the impact surface at an angle of between 85 and 95 degrees. Impact of the water with the impact surface crushes the cavitation bubbles in the (Continued)

injected water to generate pressure above 1,000 pounds per square inch and produce superheated steam.

7 Claims, 18 Drawing Sheets

(58) Field of Classification Search
USPC ..... 122/26, 40, 41, 446
See application file for complete search history.

(56) References Cited

U.S. PATENT DOCUMENTS

| | | | | |
|---|---|---|---|---|
| 9,574,765 | B2 | 2/2017 | Aho | |
| 2004/0261416 | A1 | 12/2004 | White | |
| 2008/0202454 | A1* | 8/2008 | Pirault | F02B 33/22 123/58.8 |
| 2008/0271454 | A1* | 11/2008 | Hansen | F01K 23/065 60/670 |
| 2009/0100832 | A1 | 4/2009 | Loeffler | |
| 2010/0293949 | A1* | 11/2010 | Aho | F01K 15/02 60/670 |
| 2012/0267232 | A1* | 10/2012 | Riley | B01D 1/225 203/11 |
| 2013/0145997 | A1* | 6/2013 | Aho | F22B 27/16 122/40 |
| 2015/0198327 | A1* | 7/2015 | Liu | F22B 1/22 122/40 |

* cited by examiner

DETAIL F

CAVITATION ENGINE

CROSS-REFERENCE TO RELATED APPLICATION

This application claims priority to U.S. Provisional Application No. 62/162,970, filed May 18, 2015, and entitled CAVITATION ENGINE, incorporated herein by reference in its entirety

FIELD

The present disclosure relates to cavitation engines. More particularly, the disclosure relates to cavitation engine structures that generate steam from liquid water fed into the engine in a manner that enables improved efficiency to conventional steam generation devices.

BACKGROUND

Improvement is desired in the construction of engines or the like that generate steam from water fed into the engine. Conventional engines or like devices that convert liquid water to steam are inefficient in terms of their energy use.

The present disclosure relates to more energy efficient engine structures configured to inject liquid water in a controlled to promote the formation of cavitation bubbles within the injected water, and to impact the injected water onto an impact surface of an impact chamber to crush the cavitation bubbles to generate very high pressure superheated steam that can be used to generate electricity or otherwise harnessed as an energy output.

SUMMARY

Cavitation engines according to the disclosure are configured to produce high pressure superheated steam from injected liquid water.

In one aspect, a cavitation engine according to the disclosure includes an impact chamber having an impact surface having a temperature of at least 375 degrees Fahrenheit, and a fluid injector having an outlet positioned to inject hyperbaric liquid water onto the impact surface of the impact chamber at supersonic velocities such that cavitation bubbles are present in the injected water. The outlet of the fluid injector and the impact surface are located relative to one another such that the outlet is spaced a distance from the impact surface of between 0.150 and 0.450 inches and the injected water hits the impact surface at an angle of between 85 and 95 degrees. Impact of the water with the impact surface the crushes the cavitation bubbles in the injected water to generate pressure above 1,000 pounds per square inch and produce superheated steam.

In another aspect, the cavitation engine according to the disclosure includes a funnel shaped impact chamber having an impact surface having a temperature of at least 375 degrees Fahrenheit, a small diameter opening at a bottom of the impact chamber, and an expansion chamber below the small diameter opening. The engine includes a fluid injector having an outlet positioned adjacent a largest diameter of the impact chamber and located to inject hyperbaric liquid water onto the impact surface of the impact chamber at supersonic velocities such that cavitation bubbles are present in the injected water. The outlet of the fluid injector and the impact surface are located relative to one another such that the outlet is spaced a distance from the impact surface of between 0.150 and 0.450 inches and the injected water hits the impact surface at an angle of between 85 and 95 degrees. The cavitation bubbles in the injected water are crushed by the impact of the injected water onto the impact surface and gases inside the cavitation bubbles rapidly increases in temperature to create superheated steam and pressure. The pressure forces the superheated steam through the small diameter opening of the impact chamber.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
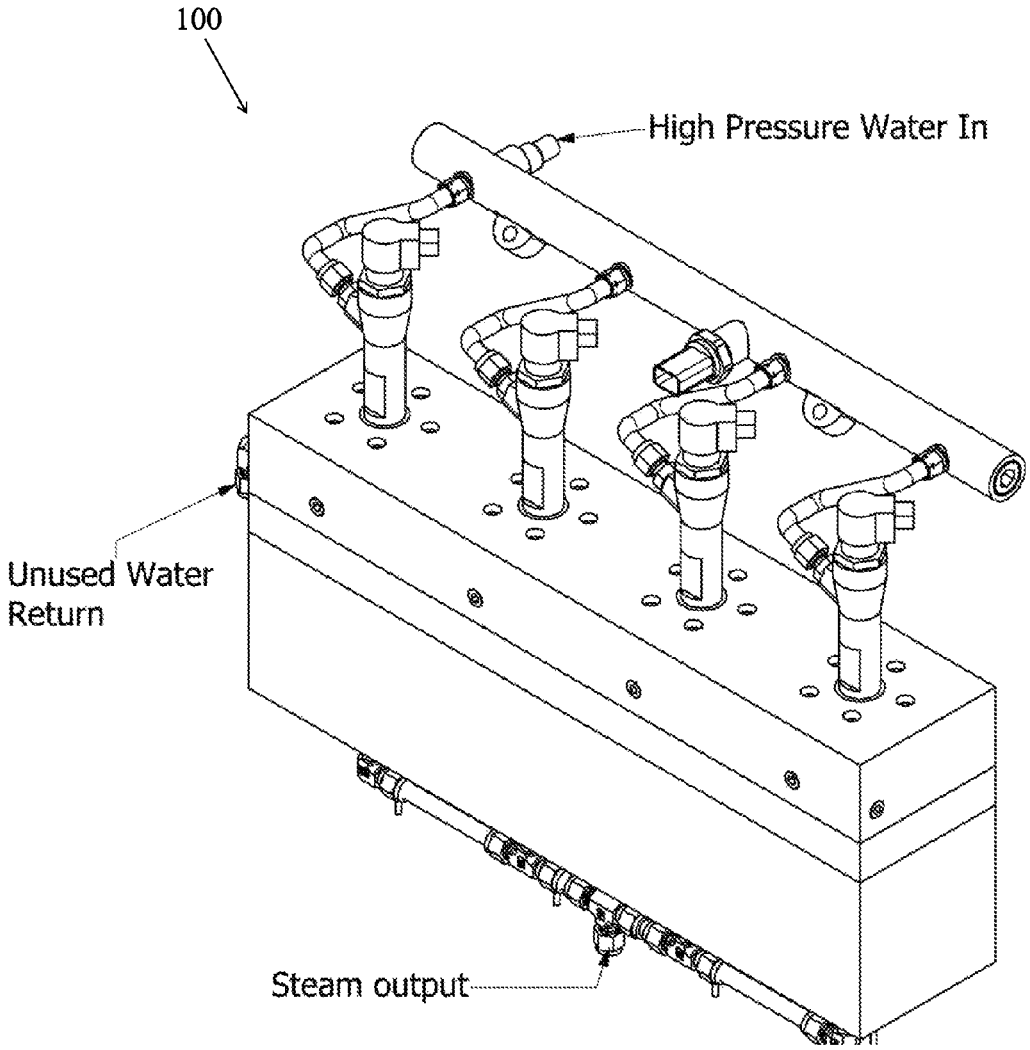
FIG. 1 is a perspective view of a cavitation engine according to the disclosure.
Figure 2:
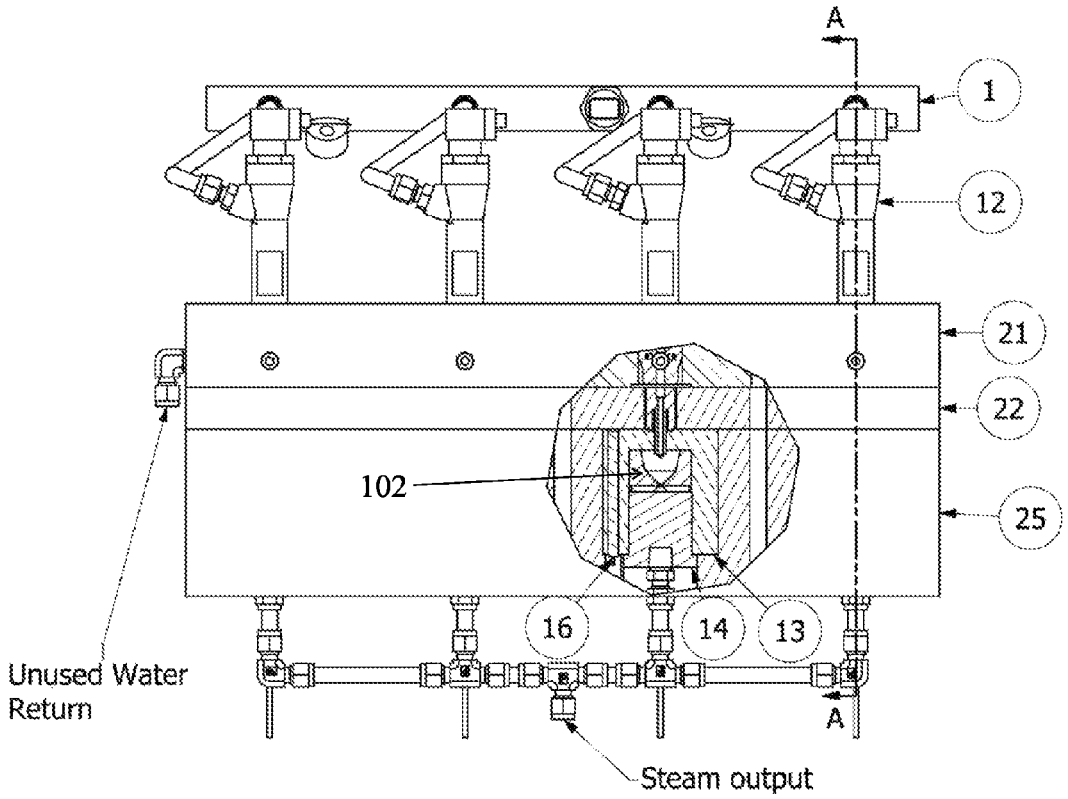
FIG. 2 is a frontal view of the cavitation engine of FIG. 1, with a portion cutaway to show internal details.
Figure 3:
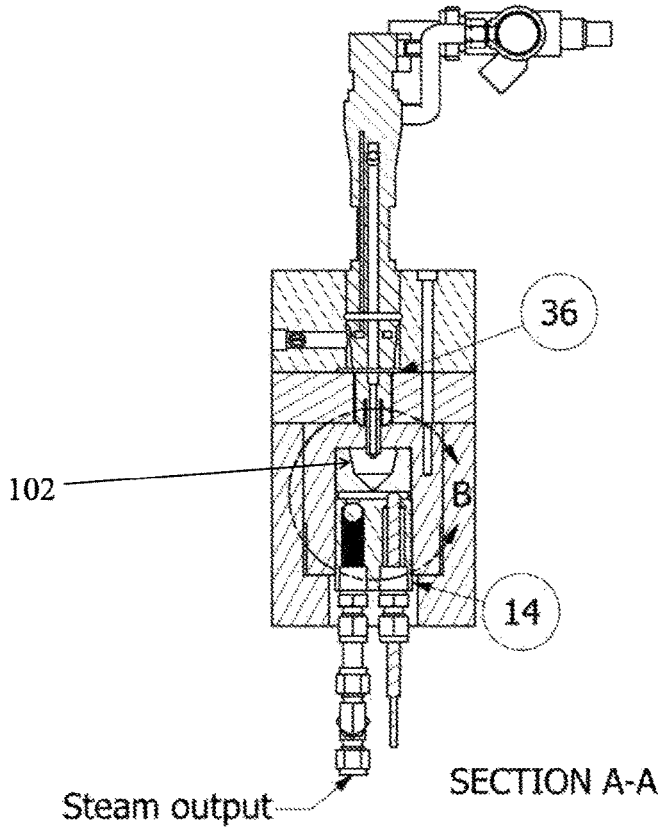
FIG. 3 is a cross-sectional view taken along line A-A of FIG. 2.
Figure 4:
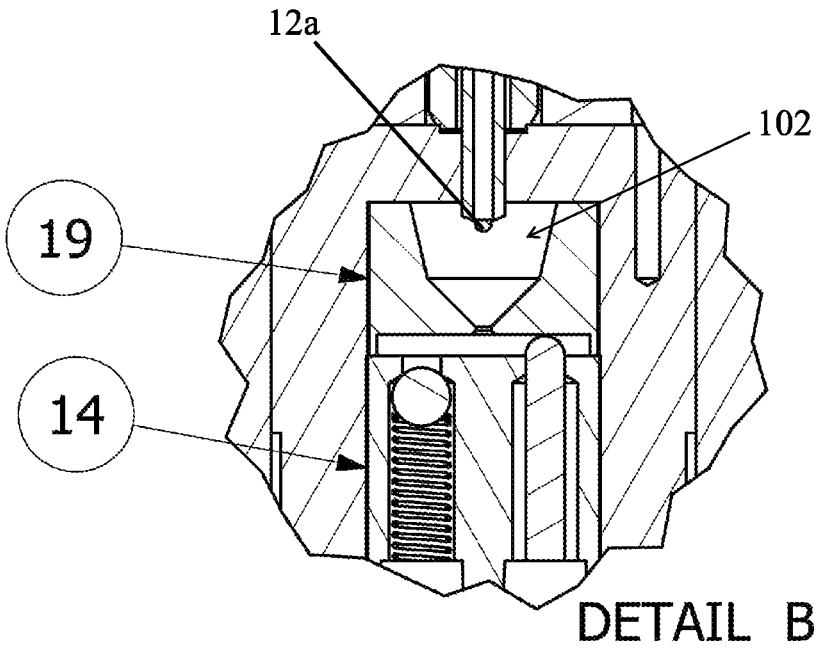
FIG. 4 is a detailed view of a portion of FIG. 3.
Figure 5:
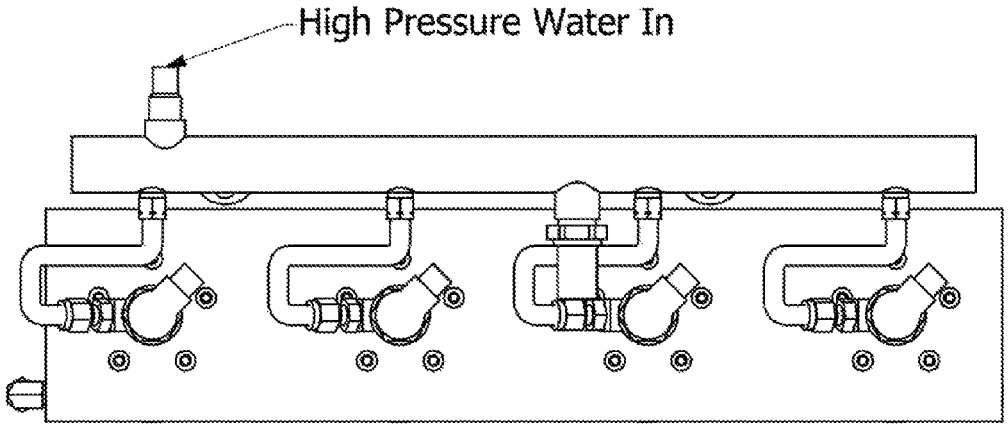
FIG. 5 is a top view of the cavitation engine of FIG. 1.
Figure 6:
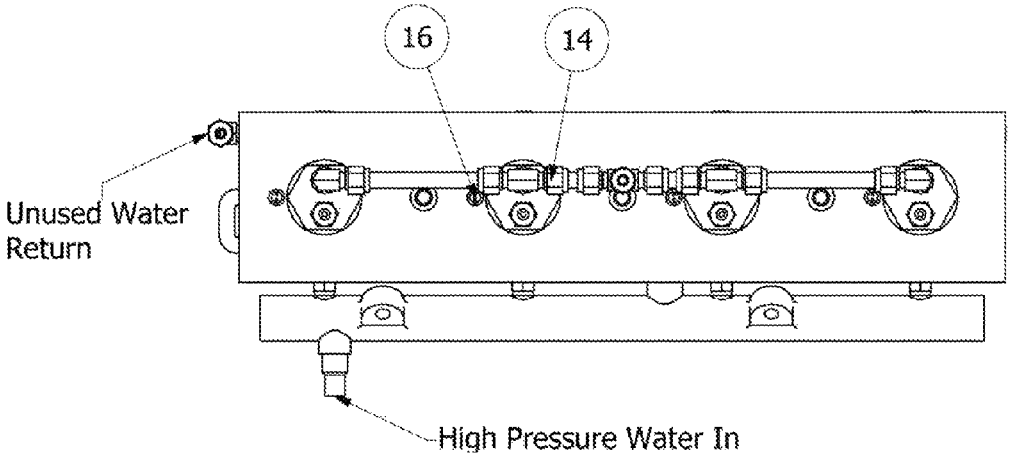
FIG. 6 is a bottom view of the cavitation engine of FIG. 1.
Figure 7:
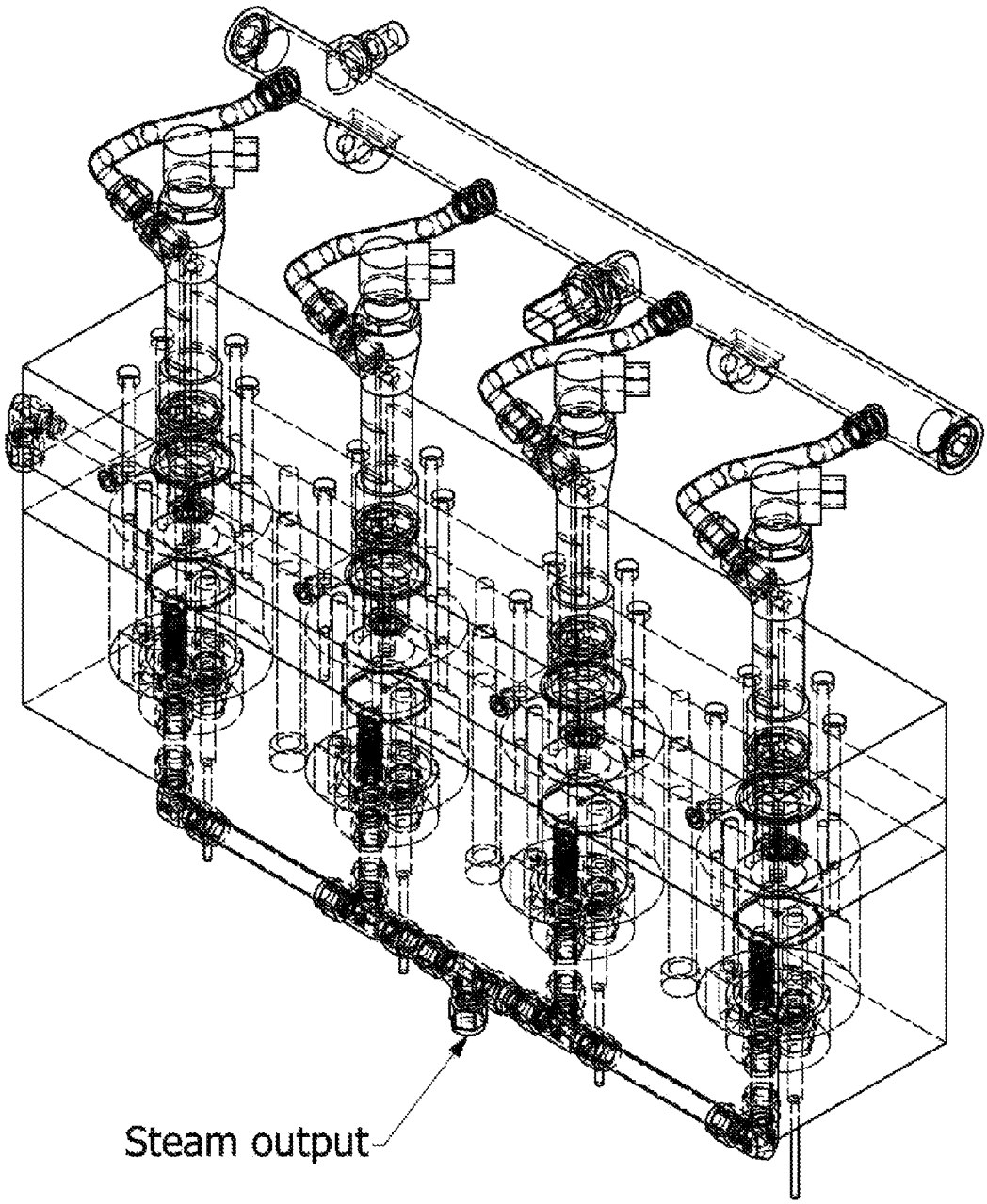
FIG. 7 is a transparent perspective view of the cavitation engine of FIG. 1.
Figure 8:
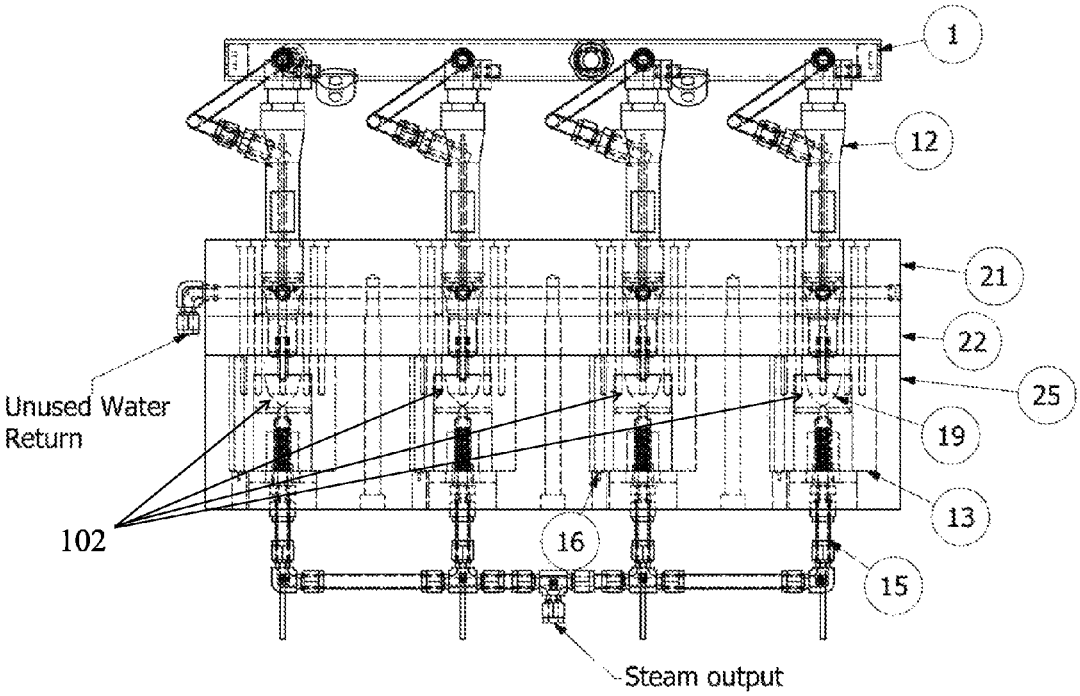
FIG. 8 is a transparent frontal view of the cavitation engine of FIG. 1.
Figure 9:
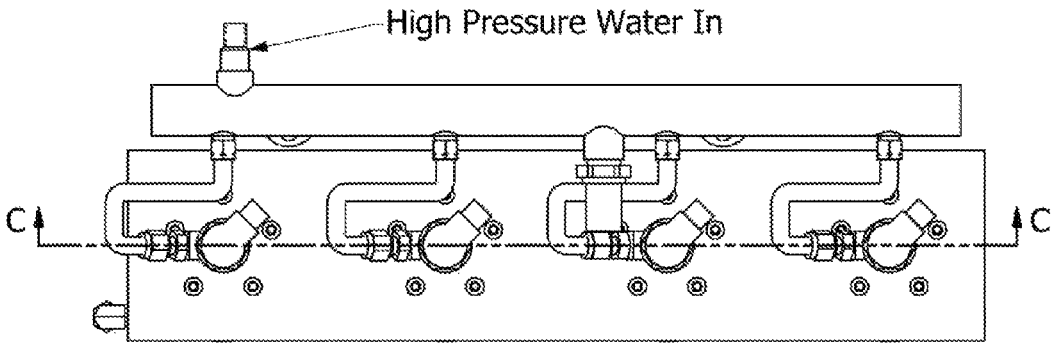
FIGS. 9-19 show various cross-sectional and detailed views of the cavitation engine of FIG. 1.
Figure 10:
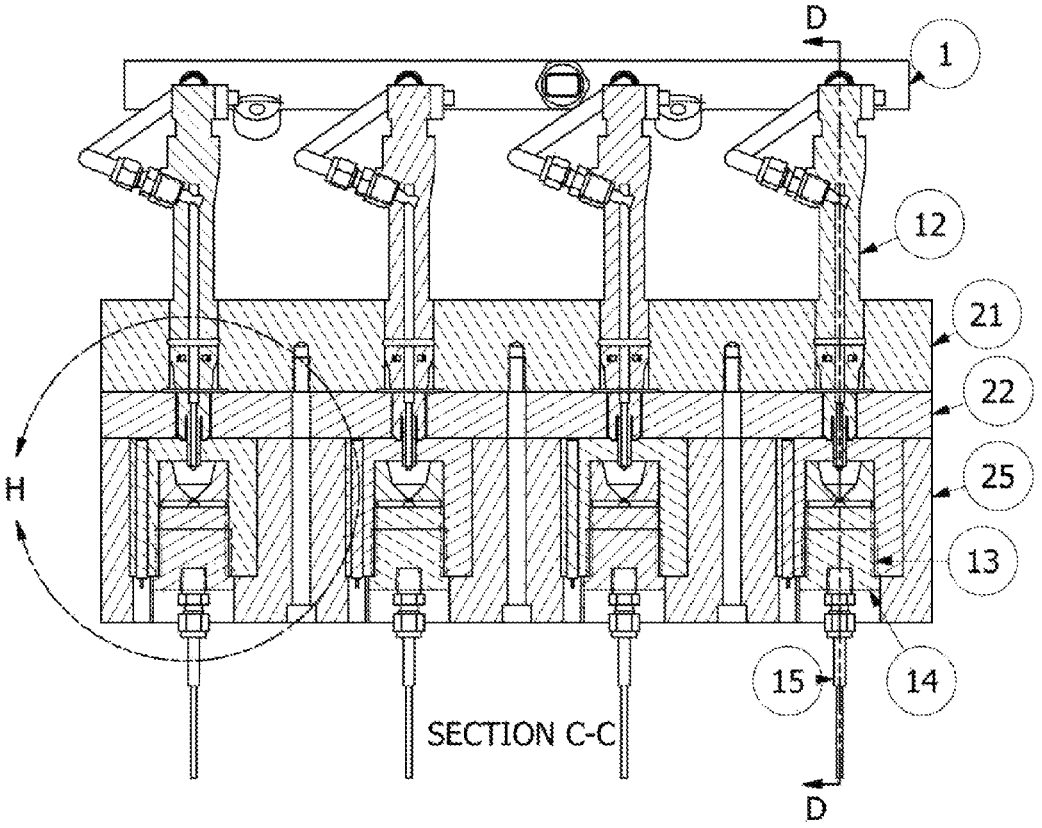
Figure 11:
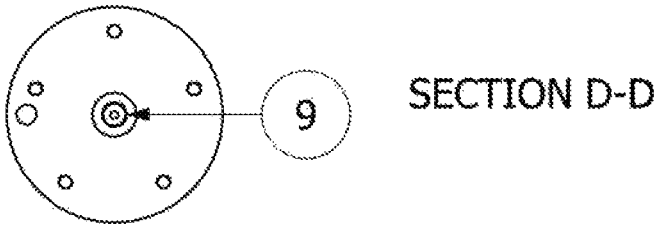
Figure 12:
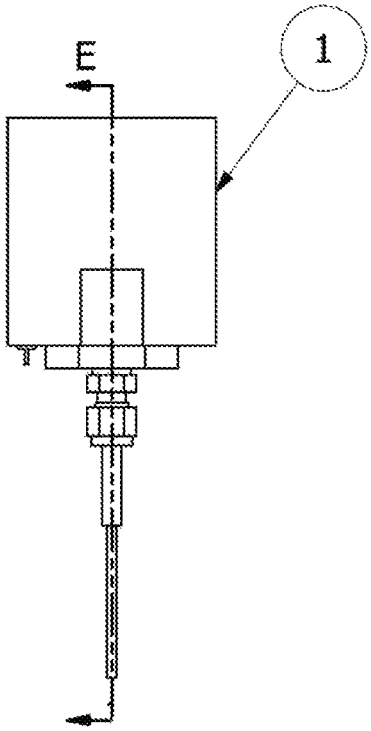

With reference to the drawings, the disclosure relates to a steam engine, and in particular to a cavitation engine 100. The cavitation engine 100 produces superheated steam by injecting hyperbaric liquid water at supersonic velocities to create cavitation bubbles within the injected water. The water is injected into specially configured, heated impact chambers 102 having impact surfaces 102*a* configured to crush or collapse the cavitation bubbles.

It has been discovered that injecting water in a manner that forms cavitation bubbles in the water and impacting the water to crush the cavitation bubbles generates very high pressure superheated steam that can be used to generate electricity or otherwised harnessed as an energy output. The feed water can be ambient temperature, but may be initially heated, but injected as a liquid.

The impact chamber 102 is advantageously configured to provide a funnel like curvature of the chamber 102 as shown in the drawings that opens towards a fluid injector with the largest dimension closest to the injector. It has been discovered that the described shape and configuration of the impact chamber 102 desirably produces very high water hammer pressure during collision of the water fraction that rapidly crushes the cavitation bubbles.

The engine 100 and the impact chambers 102 include the following components, as shown in the drawings:

| Ref. # | Component |
|---|---|
| 1 | High pressure fuel rail |
| 2 | Thermocouple probe |

-continued

| Ref. # | Component |
|---|---|
| 4 | Wire to thermocouple probe |
| 6 | Pressure relief valve |
| 7 | Spring for pressure relief valve |
| 8 | Insert for impact chamber 102 |
| 9 | Entrance for injector |
| 12 | Piezoelectric injector |
| 13 | Outer shell of impact chamber 102 |
| 14 | Pressure regulating plug |
| 15 | Immersion thermocouple probe |
| 16 | Heater |
| 19 | Insert for impact chamber 102 |
| 20 | Copper washer |
| 21 | Injector retention block |
| 22 | Injector insulator block |
| 25 | Injector insulator block |
| 36 | O-ring |

Each impact chamber 102 is preferably initially pre-heated to 375 degrees F. Once the engine 100 is operating, the energy supplied for the pre-heating may be ceased, as it has been observed that the temperature of the impact chambers 102 will remain above 375 degrees F. due to the operation of the engine 100. For example, the thermocouple probe 2 may be connected to a digital controller for providing the desired pre-heating.

Cavitation will be understood herein to refer to the formation of vapor cavities in a liquid. The vapor cavities are characterized as small liquid-cavitation-free zones in the nature of bubbles or voids that are the consequence of cavitational forces acting upon the liquid. Cavitiation occurs when a liquid is subjected to rapid changes of pressure that cause the formation of cavities where the pressure is relatively low. When subjected to higher pressure, as in the case of the cavitation engines according to the disclosure, it has been observed that the voids implode or are otherwise crushed and generate an intense shockwave and high pressure.

Thus, it will be understood that engine structures according to the disclosure are configured to receive injected water and to promote cavitation of the injected water to generate very high pressure that can be used to generate electricity or otherwise harnessed as an energy output. That is, the injector 12 injects water in a manner such that bubbles or voids are created in the stream of injected water, referred to herein as cavitation bubbles.

In accordance with the disclosure, and without being bound by theory, it is believed that when the injected water collides with the impact surface 102*a* of the impact chamber 102, a shock wave occurs and the water is shattered to crush the bubbles and the water is instantly transformed into superheated steam. That is, the injector 12 operates to form cavitation bubbles in the water and the impact surface 102*a* cooperate so that that cavitation bubbles in the injected water are crushed upon impact of the water with the impact surface 102*a*.

Thus, cavitation engines according to the disclosure encompass (1) injecting liquid water in a manner that creates cavitation bubbles, and (2) impacting the water onto an impact surface in a manner that rapidly crushes the cavitation bubbles upon impact. The injected water is desirably substantially saturated with cavitation bubbles. Crushing of the cavitation bubbles in this manner causes the temperature of the gases inside the bubbles to rapidly increase and raise the temperature of the surrounding water and the resulting steam, which creates high pressure superheated steam. The described structures have successfully been operated to inject water in a manner that results in the generation of high pressure superheated steam.

Figure 13:
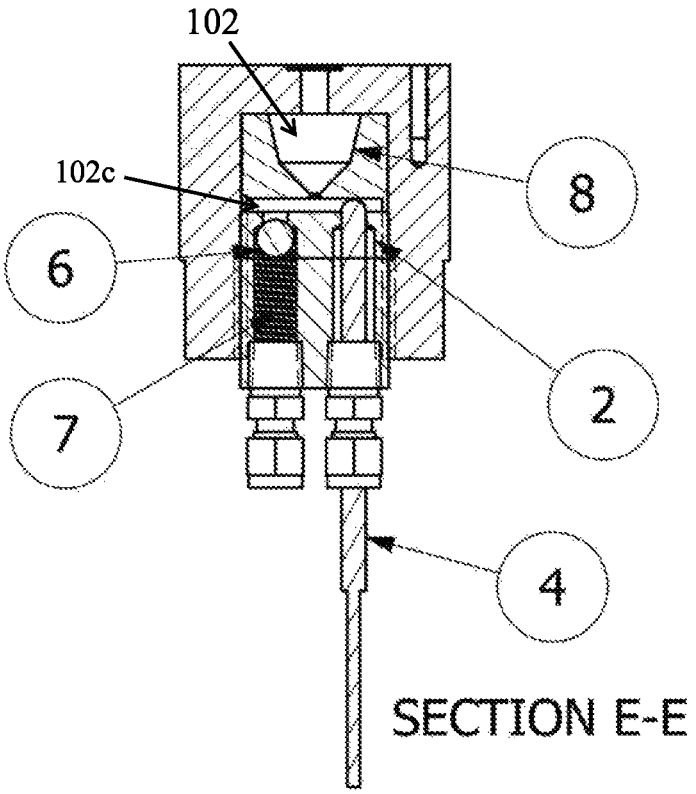
Figure 14:
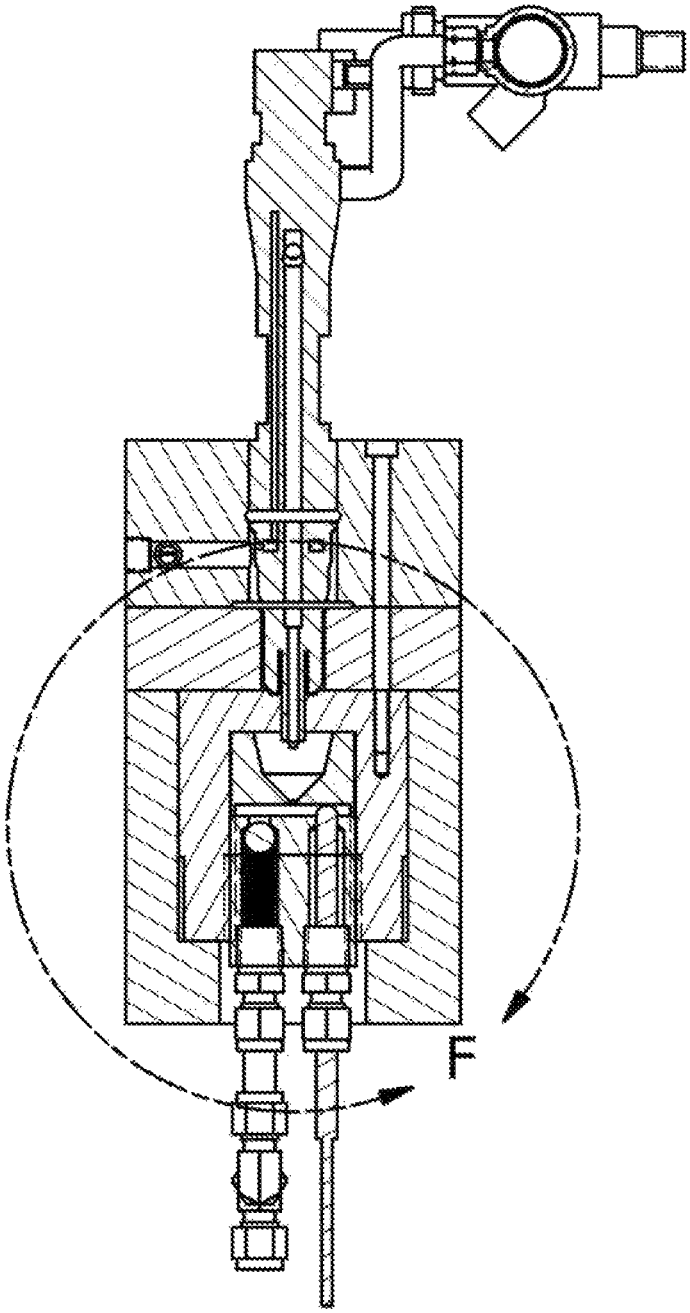
Figure 15:
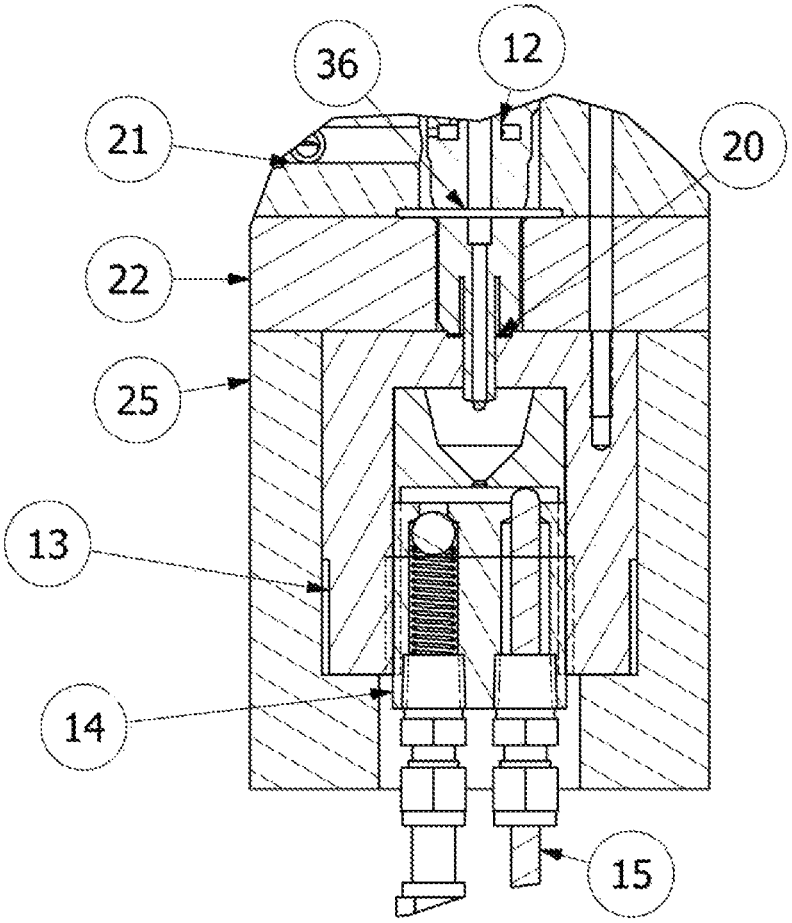
Figure 16:
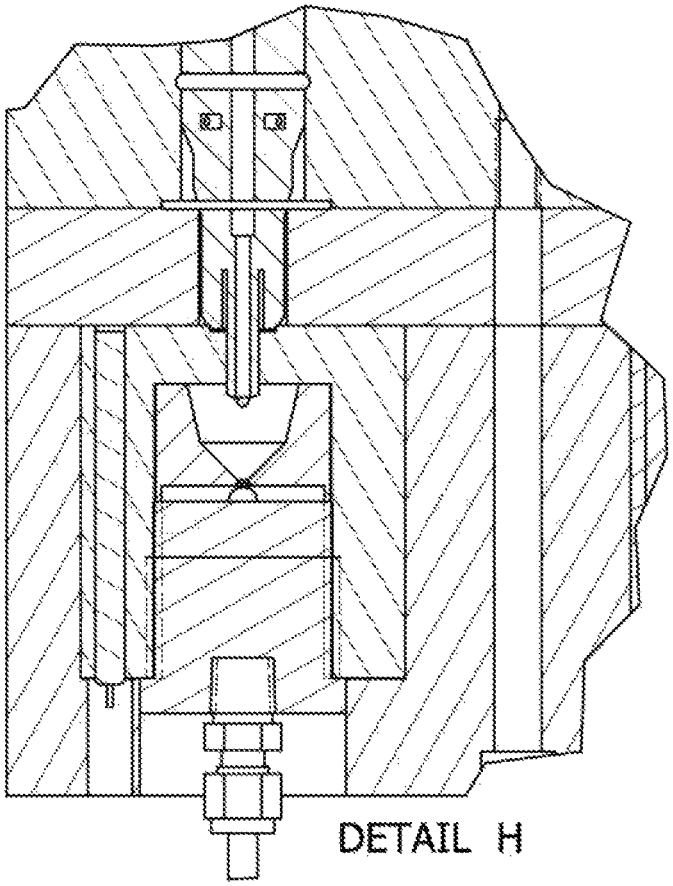
Figure 17:
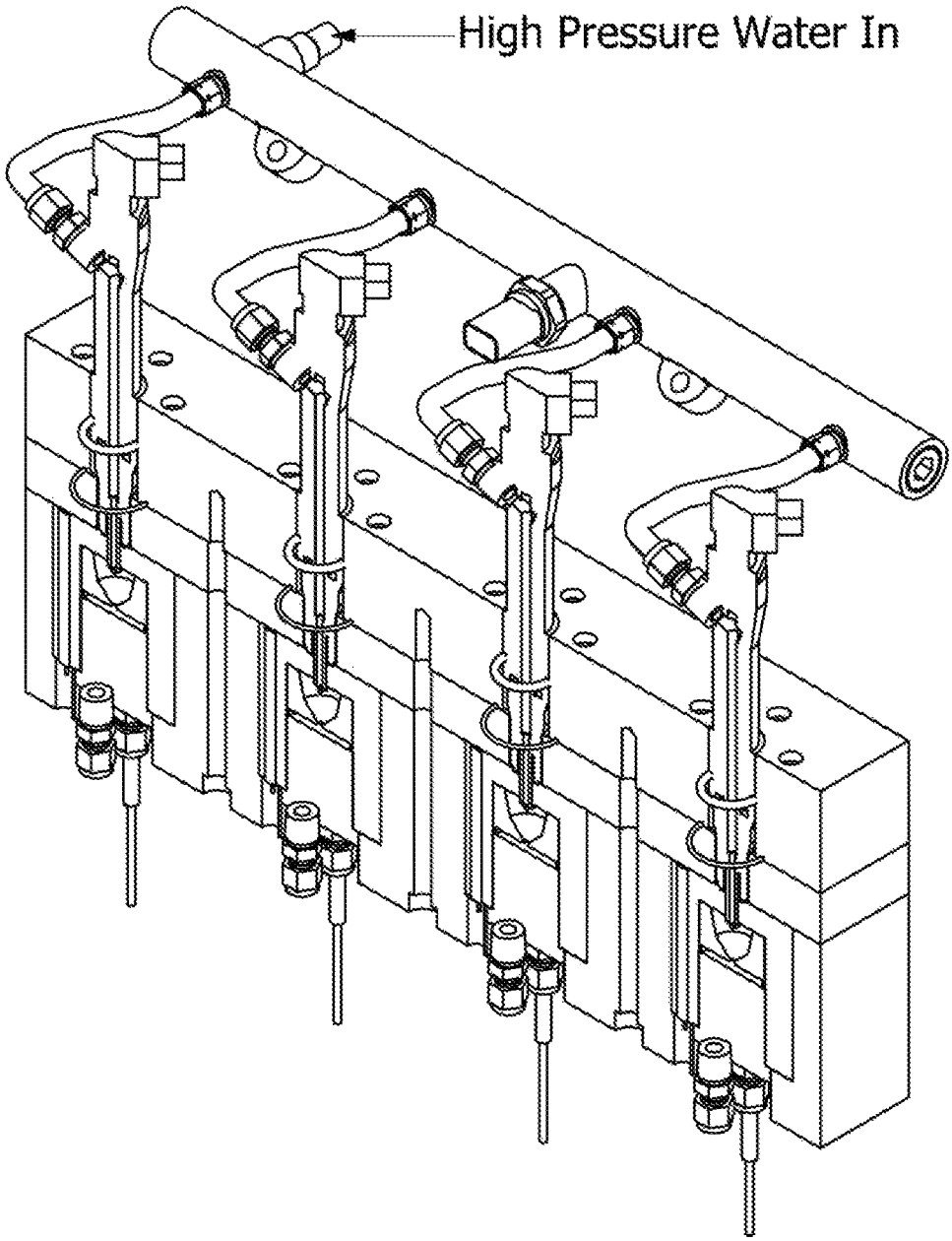

The superheated steam produced by the collision of the injected liquid water with the impact surface 102*a* is channeled through a small diameter opening 102*b* to an enlarged area providing an expansion chamber 102*c* of the impact chamber 102 (FIG. 13). The pressure relief valve 6 retains the pressure until it exceeds a pre-set spring pressure, at which point the valve 6 permits exit of the pressure which may be routed for further use. For example, the engine 100 may be utilized to power an electric generator or the like.

For the purpose of example, an uppermost diameter of the impact chamber 102 adjacent the injector 12 is about 1.2 inches. The preferred outside diameter of the small diameter opening for such an impact chamber is 0.150 inches (ratio 0.150/1.2=0.125). In addition, it has been observed that it is desirable that the volume of the expansion chamber 102*c* not exceed the volume of the impact chamber.

It has been observed that the angle of incidence of the water as it strikes the impact surface 102*a* and the proximity of the impact surface 102*a* of the impact chamber 102 to an orifice or outlet 12*a* of the fluid injector 12 are critical to the functioning of the cavitation engine of the disclosure. The pressure of the water as it is injected and the orifice size of the outlet 12*a* also affect the velocity of the injected water. The velocity of the water directly affects the shock wave at the impact surface 102*a* and the resulting water hammer pressure within the droplet containing the vapor nano bubbles.

The pressure of the injected water preferably ranges from about 5,000 psi to about 30,000 psi, most preferably about 20,000 psi. Preferred water velocities range from 1,500 meters/second to 2,000 meters/second. In the case of water injected at 20,000 psi, an injector is used having an orifice of 0.005 inches in diameter, and operated to inject pulses of water of 0.295 ml/pulse. Water injected in this manner has a velocity of 1,700 meters/second.

Figure 18:
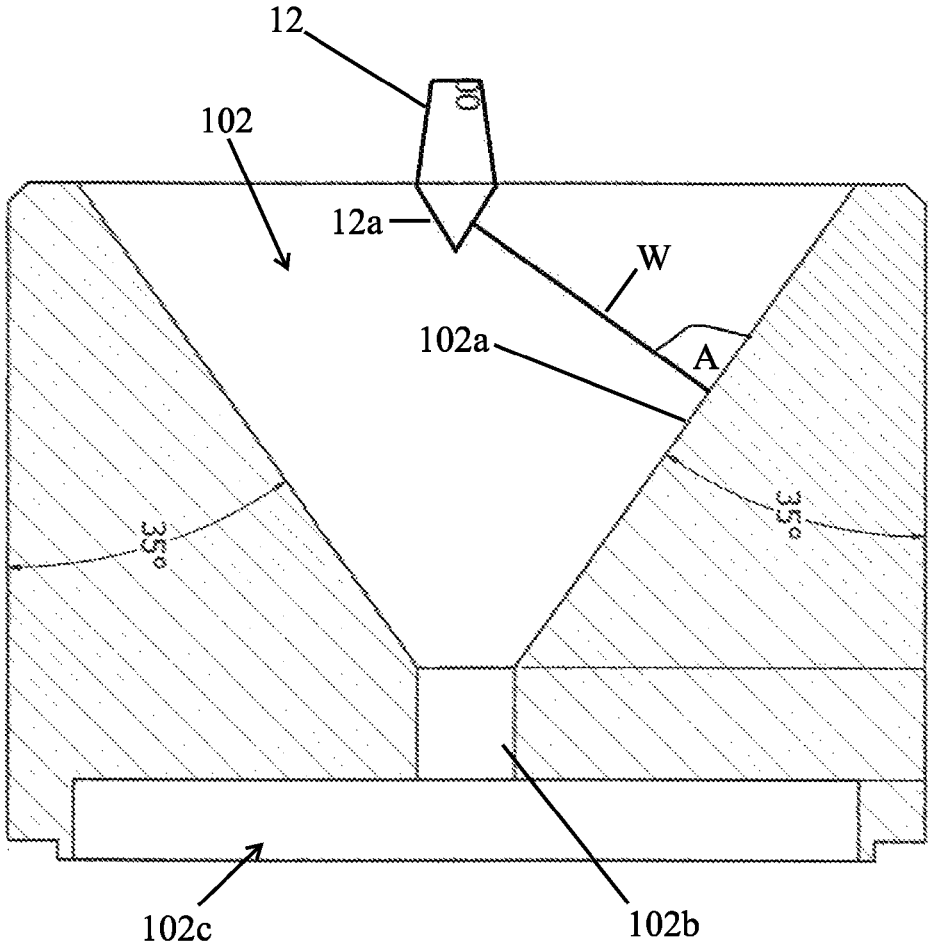

It has also been discovered that it is desirable that the injection angle of the injector 12*a* and the angle of the impact surface 102*a* be configured to cooperate so that the injected water hits the impact surface 102*a* at an angle A of from about 85 to 95 degrees, and most preferably about 90 degrees (FIG. 18). Thus, for different injectors having a different injection angle, the inclination of the impact surface 102*a* of the impact chamber 102*a* is selected so that the injected water hits the impact surface 102*a* at an angle of about 90 degrees.

For example, with reference to FIG. 18, there is shown the impact chamber 102 with the injector 12*a* provided as by a hydraulic injector which injects water at an angle of about 35 degrees. As shown, the impact chamber 102 is thus configured so that the impact surface 102*a* is at an angle of about 35 degrees so that the injected water represented by line W hits the impact surface 102*a* at an angle of about 90 degrees.

It will be understood that the injected water will be provided in a 360-degree swath and that the impact surface 102*a* is also a 360-degree surface as it is funnel shaped. However, it will be appreciated that the injected water follows a spray line as represented by the line W so that the injector 12*a* is a desired distance from the impact surface 102*a* as described more fully below.

Figure 19:
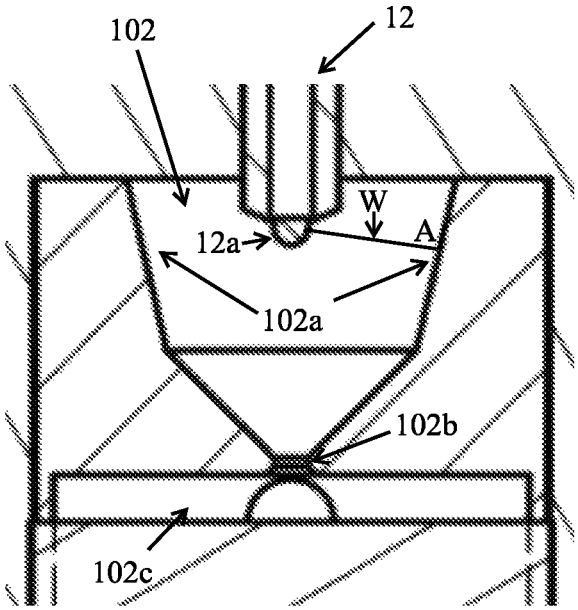

In another example, FIG. 19 shows the injector 12*a* provided as by a Ford piezoelectric diesel fuel injector which injects water at an angle of about 15 degrees. As will be observed, the impact surface 102*a* is oriented so that the injected water hits the impact surface 102*a* at an angle of about 90 degrees. As will be observed, the sidewalls of the impact chamber 102 below the impact surface 102 increase in slope to taper the lower end of the chamber 102 to the small diameter opening 102*b*.

In regards to the proximity of the outlet of the injector 12 to the impact surface 102*a*, it will be seen that the injector 12 terminates at the outlet 12*a* that extends into an upper portion of the impact chamber 102. The outlet 12*a* is positioned to inject liquid water onto the impact surface 102*a*. The outlet 12*a* is desirably located a distance of between about 0.150-0.450 inches from the impact surface 102*a* of the impact chamber 102. This distance of the outlet 12*a* to the impact surface 102*a* is represented by the length of the line W in FIGS. 18 and 19.

It has been observed that greater distances will tend to dissipate the injection stream and the vapor bubbles present in the stream will be lost. It is important that the water injection, which is saturated with cavitation bubbles, impacts the surface with maximum force so that the water hammer pressure crushes the bubbles and releases the energy associated with the bubble collapse.

It is desirable to maximally collapse these bubbles to obtain the greatest heat energy, which is a function of the cube of the bubble ratio (Radius expanded/Radius collapsed) and product of the pressure ratio. It is believed that this is why the heat observed during operation of the engine is so intense. In this regard, it is believed that an oxyhydrogen covalent separation occurs where temperatures in excess to 3000 degrees C. are required to get about 50% disassociation. The impact water hammer pressure drops off exponentially as the distance from the injector orifice increases. The angle of impact also affects the impact pressure. Placing the injector close to the impact surface makes no sense from a combustion engineering view point, but in our case it is important.

Accordingly, it will be appreciated that the timing, distance and geometry of the impact chamber 102 are critical in desired operation of the engine system and the production of heat. The engine system operates with pressures between about 15000-28000 psi. A variety of injector orifice diameters may be used, it being understood that the pressure and orifice determine the degree of cavitation in the injection stream.

The timing of the injections also affects the operation of the engine. The water is desirably injected as discrete pulses. The width of each pulse controls the volume of water injected. The number of injections per second controls the amount of steam production per hour in pounds of steam/hour. All of this requires an instant response to all of the sensors. Accordingly, the impact chamber temperature is controlled to manage the output steam temperature required by the water prime mover, such as a turbine, rotary expander, reciprocating steam engine etc. Controlling the volume of steam produced per second will affect the rotation rate of a steam engine which in turn may be driving a generator or other device. A computer control system it desirably utilized to monitor and adjust injection rates and volumes, impact chamber temperatures, generator rpm and output pressure.

As noted above, it is believed that cavitation is responsible for the heating which occurs within the impact chamber. Cavitation occurs within the orifice of the fuel injector nozzle when the local flow pressure drops below the vapor pressure of the liquid. As the pressurized and compressed water expands through the orifice the liquid accelerates. The flow streamlines contract as the liquid ejects from the nozzle and according to the Bernouilli principle this causes a reduction in the local static pressure which can become lower than the vapor pressure of the water leading to extensive cavitation bubble formation. These cavitation bubbles are ejected from the nozzle at supersonic velocity into the impact chamber. When they collide with the impact surface 102*a* they are crushed from the pressure.

Additional cavitation bubbles form as the fluid ejection fraction travels towards the impact surface 102*a* as the ambient pressure within the impact chamber is significantly less than the pressure of the exiting water. The distance from the injector orifice is critical to the operation of the system and must be between 0.150 and 0.450 inches or the cavitation bubbles will dissipate before hitting the impact chamber wall.

The water hammer shock wave pressures encountered as the water droplet hits the impact surface 102*a* can be well in excess of 275 MPa (Mega Pascals). This pressure is more than enough to crush any vapor bubbles which have been formed. The energy released when this phenomena occurs can be in excess of 30,000 degrees K (Kelvin). Since these temperatures are well in excess of that required to obtain molecular hydrogen and oxygen separation in water (temperatures above 3000 degrees C. result in 50% molecular separation) a significant portion of the water separates and subsequently combusts releasing heat energy.

In a preferred embodiment, the engine 100 includes banks of eight impact chambers arrayed together. Without being bound by theory, it is believed that as a result of the crushing of the vapor bubbles, heat is generated via conduction at the point of impact and additional heat is infrared or radiated heat. The use of 310 stainless steel which has a relatively low thermal conductivity for the impact chambers 102 is preferred to absorb the infrared heat. 310 stainless steel at 212 degrees Fahrenheit has a thermal conductivity of 8.0. The 310 stainless steel is also desirable as a material for capturing the radiant heat because it has a relatively low thermal emissivity. Emissivity is a measure of the efficiency in which a surface emits thermal energy. Emissivity is the fraction of energy being emitted relative to that emitted by a thermally black surface having an emissivity value of 1. An emissivity value of 0 represents a perfect thermal mirror. 310 stainless steel treated for furnace service has an emissivity of between about 00.90 to 0.97.

Ceramic or other insulating material may additionally be used to separate the injector body from the impact chamber to minimize heat loss and to capture heat. The primary loss of heat is through steam exiting from the pressure relief valve. The steam exiting the pressure relief valve is superheat steam and can be used to drive a reciprocating steam engine or a rotary expander type turbine. It has been observed that capture of the radiant heat inside the impact chamber offers significant advantages to the operation of the cavitation engine.

The rotational speed of the steam engine or rotary expander may be controlled as by adjusting the flow of superheat steam from the cavitation engine. This steam output flow is adjusted by varying the injection rate (injections/second) of the individual impact chambers. As additional output power is required, the number of impact chambers used and the injection rate per chamber are varied in real time, according to demand.

A high pressure triplex water pump system may be used to provide high pressure water (>20,000 psi) to the common rail manifold supplying the fuel/water injectors. The speed of the pump and thus the pressure is regulated by controlling the power flow to a DC electric motor. A control computer monitors the common rail manifold pressure and adjusts the pump speed to maintain this pressure. To minimize power consumption the pump is only run on demand for feedwater to the injectors.

An injector control module is used to supply the 140 V DC power required to fire the piezo type fuel injectors. A central control computer controls the impact chamber electric heaters, the impact chamber injection rate, the feedwater temperature and the cyclical rotation rate of the prime mover (steam engine, steam turbine) driving the power generators.

Figure 20:
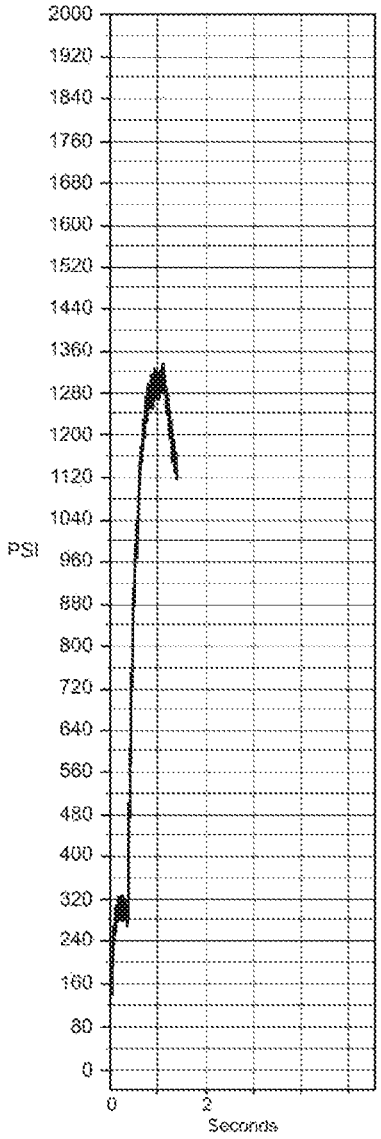
FIG. 20 is a graph showing operation of a cavitation engine according to the disclosure.

A cavitation engine according to the disclosure was successfully operated and yielded the pressure results shown in FIG. 20. The engine utilized for the results shown in FIG. 20 utilized a single injector and a single impact chamber. No relief valve was provided and an Omega pressure transducer was utilized to obtain instantaneous pressure readings. Because of the pressures generated, it was difficult to continuously operate the engine due to failure of seals. Thus, tests were kept short (1-2 seconds) while efforts are being made to improve the longevity of the seals.

For the purpose of example, for the operation of the engine for the results shown in FIG. 20, the impact chamber was initially pre-heated to 375 degrees F. using an electrical heater, and then power to the heater was turned off once the pre-heating was accomplished. The pre-heated sealed impact chamber and expansion chamber of the engine were under 3 cubic inch, and the freshwater feed water was 160 degrees F. After two seconds of operation, resulting in 10 injections (5 injections per second), the impact chamber was heated to 575 degrees F. and produced pressure of 1,340 PSI. In another test of 3 seconds (5 injections per second), a pressure of 1,950 psi was achieved before the seal failed.

The results have also been observed to differ based on the salinity of the water. In this regard, it was observed that cavitation increased with seawater (4% salt solution) as compared to fresh water. It is believed that other liquids may be utilized other than water.

When the injector device is fired pre-heated water is injected at pressures ranging from 20,000-25,000 psi. The high pressure drop across the injection nozzle as the water exits to near atmospheric pressure within the impact chamber, tends to accelerate the liquid within the small nozzle holes.

At the sharp edges inside the nozzle holes, such as the inlet of the nozzle hole, the streamlines are contracted such that the effective cross section of the flow is reduced leading to accelerated velocity of the liquid. According to Bernoulli principle, this causes a reduction in the local static pressure and it can reach values as low as the vapor pressure of the liquid. When the local pressure becomes lower than the vapor pressure of the liquid at local temperatures large numbers of cavitation bubbles form within the injection stream.

Since the temperature of the ejecting liquid approaches 90 degrees C., the vapor pressure is increased as much as 40 times that of room temperature. This situation further increases the amount of cavitation bubbles forming. Without being bound by theory, it is believed that as the water droplets forming the injection stream travel towards the impact chamber the gas in the cavitation bubbles expands. Upon impact with the chamber wall there is a sudden increase in hydraulic pressure within the droplet due to the water hammer effect. The momentary internal pressures can be on the order of tens of thousands of psi. The collision of the injection droplets with the impact chamber wall causes cavitation bubbles within the droplet to be crushed.

When the bubbles are forced to a very small diameter by impact, the gas inside the bubble approaches extremely high temperatures, and the bubbles explode and collapse. The temperatures inside these collapsed cavitation bubbles can reach many thousands of degrees K (Kelvin). At these high temperatures the gas becomes a superheated plasma in which the water molecules are reduced to their constituent atomic components less the surrounding electrons. The collective heat from this vast quantity of bubbles can raise the temperature of the surrounding water and resulting steam.

It has been observed that cavitation engines according to the disclosure have substantially improved efficiency as compared to conventional steam engines, such as conventional external combustion Rankine Cycle steam boilers.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A cavitation engine configured to produce superheated steam from injected liquid water, the engine comprising:

an impact chamber having an impact surface;

a heater to initially heat the impact surface to a temperature of at least 375 degrees Fahrenheit;

a source of hyperbaric liquid water; and a fluid injector having an outlet positioned to inject the hyperbaric liquid water onto the impact surface of the impact chamber at supersonic velocities of about 1,500 meters/second or more such that cavitation bubbles are present in the injected water;

wherein the outlet of the fluid injector and the impact surface are located relative to one another such that the outlet is spaced a distance from the impact surface of between 0.150 and 0.450 inches and the injected water hits the impact surface at an angle of between 85 and 95 degrees, and wherein impact of the injected water with the impact surface crushes the cavitation bubbles in the injected water to generate pressure above 1,000 pounds per square inch and produce superheated steam.

2. The cavitation engine of claim 1, wherein the injected fluid is injected using injector orifices oriented at such an angle to the impact chamber surface as to produce a nearly perpendicular trajectory.

3. The cavitation engine of claim 1, wherein the impact chamber has a funnel-like curvature opening towards the fluid injector that provides a substantially 90-degree angle of incidence of the injected water.

4. The cavitation engine of claim 1, wherein the impact surface is disposed at an angle relative to horizontal of from about 10 degrees to about 45 degrees, and the injector ejects water at an angle such that the injected water hits the impact surface at an angle of about 90 degrees.

5. The cavitation engine of claim 1, wherein the fluid injector injects the water at a pressure of about 20,000 psi or above.

6. The cavitation engine of claim 1, wherein the impact chamber has a volume and includes an opening at a bottom of the impact chamber and an expansion chamber below the opening, the expansion chamber having a volume less than the volume of the impact chamber.

7. A cavitation engine configured to produce superheated steam from injected liquid water, the engine comprising:

a funnel shaped impact chamber having an impact surface, a heater to initially heat the impact surface to a temperature of at least 375 degrees Fahrenheit, a an opening at a bottom of the impact chamber, and an expansion chamber below the opening;

a source of hyperbaric liquid water; and a fluid injector having an outlet positioned adjacent a largest diameter of the impact chamber and located to inject the hyperbaric liquid water onto the impact surface of the impact chamber at supersonic velocities of about 1,500 meters/second or more such that cavitation bubbles are present in the injected water;

wherein the outlet of the fluid injector and the impact surface are located relative to one another such that the outlet is spaced a distance from the impact surface of between 0.150 and 0.450 inches and the injected water hits the impact surface at an angle of between 85 and 95 degrees, and wherein the cavitation bubbles in the injected water are crushed by the impact of the injected water onto the impact surface and gases inside the cavitation bubbles rapidly increase in temperature to create superheated steam and pressure, and the pressure forces the superheated steam through the opening of the impact chamber.

* * * * *